United States Patent [19]

Pappas

[11] 4,060,092

[45] Nov. 29, 1977

[54] ASHTRAY AND EXTINGUISHER

[76] Inventor: James Pappas, 11576-72 Avenue, Delta, British Columbia, Canada

[21] Appl. No.: 726,493

[22] Filed: Sept. 27, 1976

[51] Int. Cl.[2] ..... A24F 13/18; A24F 19/14

[52] U.S. Cl. ..... 131/236; 131/240 R; 131/256

[58] Field of Search ..... 131/236, 231, 240 R, 131/256, 236, 235; 220/1 H

[56] References Cited

U.S. PATENT DOCUMENTS

| | | | |
|---|---|---|---|
| Re. 20,592 | 12/1937 | Vuccino | 131/236 |
| 1,828,068 | 10/1931 | Pringle | 131/236 X |
| 2,559,188 | 7/1951 | Durbin | 131/240 R |
| 2,910,073 | 10/1959 | Lookholder | 131/231 |
| 2,928,568 | 3/1960 | Franklin | 131/236 X |
| 3,606,893 | 9/1971 | Verberg | 131/236 X |
| 3,635,225 | 1/1972 | Andrews | 131/236 |
| 3,847,575 | 11/1974 | Harding | 131/256 X |

*Primary Examiner*—Stephen C. Pellegrino
*Attorney, Agent, or Firm*—Robert D. Farkas

[57] ABSTRACT

An ashtray and extinguisher including a rigid unitary housing adapted to contain therein a first chamber and a second chamber. The first chamber includes a dish element resting on the mouth thereof adapted to have cigarettes, cigars, or the like rest thereon and the ashes thereof to be scraped thereon. The second chamber is adapted to contain a liquid therein for the extinguishing of cigarettes, cigars, or the like.

7 Claims, 3 Drawing Figures

ASHTRAY AND EXTINGUISHER

BACKGROUND OF THE INVENTION

1. Field of the Invention

The present invention relates to ashtrays for use by smokers, and more particularly, to an ashtray including a chamber adapted to contain an extinguishing liquid therein.

2. Description of the Prior Art

The prior art includes several ashtrays and extinguishers which can be characterized as hard to clean and inconvenient to use. It is well known that smokers can be very inattentive to the removal of ashes from their cigarettes or cigars and to the extinguishing thereof. In order for an ashtray and extinguisher to be effective it must be very simple for the user to place the cigarette or cigar therein with a very minimal amount of attention.

In the U.S. Pat. No. 2,559,188 to Durbin issued July 3, 1951 a combined ashtray and extinguisher including a water container adapted to have cigarettes dipped therein and which surrounds a conventional ashtray type chamber is disclosed. The cigarettes are dipped into the water through relatively small holes disposed within the walls of the container.

Further included in the prior art is the U.S. Pat. No. 2,596,773 to Horikawa issued May 13, 1952 disclosing an ash receiver and extinguisher fo cigarettes having an open water channel portion and a conventional ashtray portion. A rest member transverses the ashtray portion and is adapted to have cigarettes rest thereon.

The present invention provides a grid element adapted to have cigarettes or cigars rest thereon without the danger of rolling thereoff and provides a surface to abrate the ashes therefrom. The liquid extinguishing container includes a shield element which guides a cigarette or cigar into the liquid with a minimal amount of effort by the user.

SUMMARY OF THE INVENTION

Therefore, it is a primary object of the present invention to provide an ashtray and extinguisher having means for guiding a cigarette or cigar effortlessly therein by the user.

A further object is to provide means for abrating ashes from a cigarette or cigar.

A still further object is to provide an ashtray and extinguisher which may be cleaned easily.

Still another object is to provide means for retaining the extinguisher liquid with little chance of spillage.

These objects, as well as further objects and advantages, of the present invention will become readily apparent after reading the description of a non-limiting illustrative embodiment and the accompanying drawing.

An ashtray and extinguisher according to the principles of the present invention includes a first container having a bottom portion and side portions forming a chamber including a mouth portion, a grid element adapted to rest on the mouth portion of the chamber and including a multiplicity of radially arranged wires emanating upwardly from a central ring portion on one end to an outer frame portion on the other end with the frame portion adapted to rest on the mouth, a second container having a bottom element and side elements forming a cavity and an upper opening adapted to contain an extinguishing liquid therein, a shield element affixed to the upper opening of the cavity and comprising a substantially trapezoidally shaped surface having a central opening therein with the surface shaped upwardly from the central opening, and a rigid unitary housing having a first and second cavity adapted to removably contain respectively the first and second containers therein with the first and second cavity accessible from the top of the housing.

BRIEF DESCRIPTION OF THE DRAWINGS

In order that the present invention may be more fully understood it will now be described, by way of example, with reference to the accompanying drawings, in which.

DESCRIPTION OF THE PREFERRED EMBODIMENT

Figure 2:
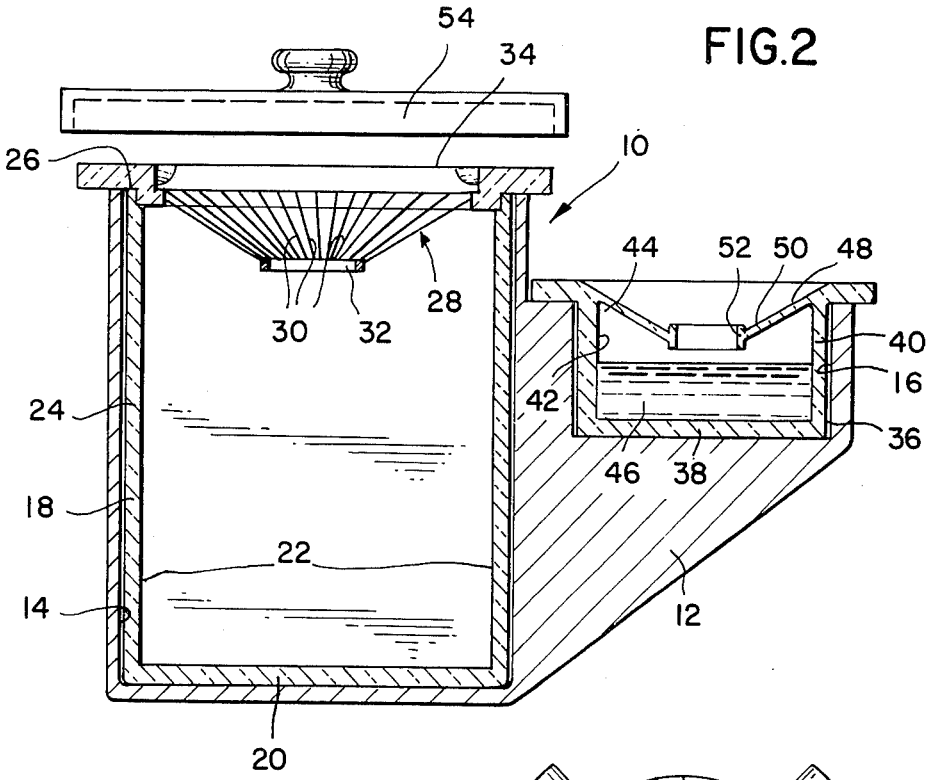
FIG. 2 illustrates a sectional elevation view of the preferred embodiment taken substantially along the line 2—2 of FIG. 1.
Figure 1:
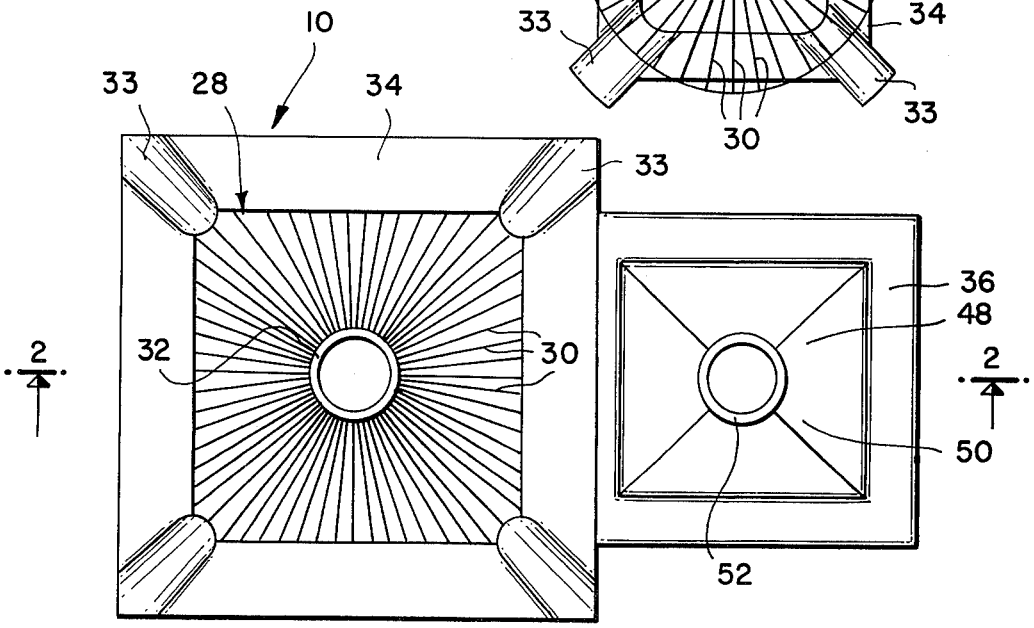
FIG. 1 illustrates a top view of the preferred embodiment of the present invention.

Referring now to the figures, and more particularly, to the FIGS. 1 and 2 there is illustrated therein the preferred embodiment of the present invention, an ashtray and extinguisher 10. The ashtray and extinguisher 10 includes a rigid unitary housing 12 having a first cavity 14 and a second cavity 16 disposed therein. The first cavity 14 is adapted to removably contain a first container 18 having a bottom portion 20 and side portions 22 forming a chamber 24 including a mouth portion 26. The first container 18 is preferably cubical in shape. A grid element 28 is adapted to rest on the mouth portion 26 of the first container 18 and includes a multiplicity of radially arranged wires 30 emanating upwardly from a central ring portion 32 to an outer frame portion 34 which is adapted to cooperate with the mouth portion 26.

Figure 3:
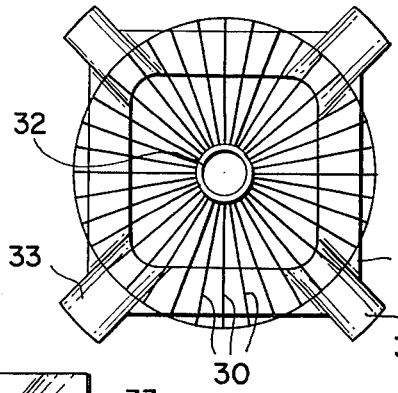
FIG. 3 illustrates an alternate construction of the grid element.

The grid element 28 and the outer frame portion 34 are preferably square in shape. The grid element 28 may be round in shape as shown in FIG. 3. The grid element 28 may also include a plurality of rest elements 33 preferably having a semi-circular cross section and adapted to support cigarettes and cigars thereon.

The second cavity 16 is adapted to removably contain a second container 36 having a bottom element 38 and side elements 40 forming a cavity 42 and an upper opening 44 adapted to contain an extinguishing liquid 46 therein. A shield element 48 is affixed to the upper opening 44 of the cavity 42 and includes a substantially trapezoidally shaped surface 50 having a central opening 52 therein, with the surface 50 being shaped upwardly from the cavity opening 52. The second container 36 is preferably cubical in shape.

A cover portion 54 is adapted to cooperate with the housing 12 and the first container 14. The first container 14 is preferably larger in size and higher in the housing 12 than the second container 36.

In use, the user rests a cigarette or cigar on the rest elements 33 or against the grid element 28. Ashes are removed by gently rubbing against the grid element 28. In order to extinguish a cigar or cigarette the user places the end thereof into the shield element 48 and urges the same toward the central opening 52. The cigar or cigarette then falls through the opening 52 and is extinguished by the extinguishing liquid 46. The cigar or cigarette is then removed and dropped through the central ring portion 32 of the first container 18. The first container 18 and the second container 36 are easily removed for cleaning.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. An ashtray and extinguisher comprising:

a. a first container including a bottom portion and side portion forming a chamber including a mouth portion;

b. a grid element adapted to rest on said mouth portion of said chamber and a multiplicity of radially arranged wires in a somewhat pyramidal arrangement emanating upwardly from a first central ring portion on one end to an outer frame portion on the other end, said frame portion adapted to rest on said mouth;

c. a second container including a bottom element and side elements forming a cavity and an upper opening and adapted to contain an extinguisher liquid therein;

d. a shield element removably affixed to said upper opening of said cavity having a substantially trapeqoidally shaped surface having a central opening at the small end thereof, said surface being sloped upwardly from said central opening, a second ring element affixed to said central opening, the upper marginal edges of said second ring element extending upwardly from a portion of said surface adjacent said second ring element; and e. a rigid unitary housing including a first and second cavity, said first cavity adapted to removably contain said first container therein and said second cavity adapted to removably contain said second container therein, said first cavity and said second cavity being accessible from the top of said housing, said mouth portion of said first container being disposed level with an open mouth portion of said first cavity, said first container being larger in size than said second container, wherein the top of said second container is lower than the top of said first container.

2. The ashtray and extinguisher according to claim 1, wherein said grid element and said frame portion are square in shape and said first container cubical in shape.

3. The ashtray and extinguisher according to claim 1, wherein said grid element further includes a plurality of rest elements adapted to support cigarettes and cigars thereon.

4. The ashtray and extinguisher according to claim 3, wherein said grid elements have a substantially semi-circular cross section.

5. The ashtray and extinguisher according to claim 1, wherein said second container is cubical in shape.

6. The ashtray and extinguisher according to claim 1, further including a cover portion adapted to cooperate with said housing and cover said first container.

7. The ashtray and extinguisher according to to claim 1, wherein said grid element is circular in shape.

* * * * *